United States Patent [19]

Jansson

[11] 4,074,620

[45] Feb. 21, 1978

[54] DEVICE FOR PREVENTING THE FLOW OF AIR THROUGH AN OPENING BETWEEN TWO ROOMS OR SPACES

[76] Inventor: Bror Ingvar Erling Jansson, Henriksdalsringen 75 nb, S-131 00 Nacka, Sweden

[21] Appl. No.: 736,673

[22] Filed: Oct. 28, 1976

[30] Foreign Application Priority Data

Nov. 6, 1975 Sweden ..... 7512468

[51] Int. Cl.[2] ..... F24F 9/00

[52] U.S. Cl. ..... 98/36; 432/64

[58] Field of Search ..... 98/36; 62/256; 432/64

[56] References Cited

U.S. PATENT DOCUMENTS

| | | | |
|---|---|---|---|
| 983,877 | 2/1911 | Cummings | 98/36 |
| 3,018,712 | 1/1962 | Wacker | 98/36 |
| 3,049,984 | 8/1962 | Boysen | 98/36 |
| 3,068,775 | 12/1962 | Zehnder | 98/36 |

FOREIGN PATENT DOCUMENTS

| | | | |
|---|---|---|---|
| 1,048,006 | 12/1958 | Germany | 98/36 |
| 1,095,497 | 5/1954 | Germany | 98/36 |
| 361,733 | 12/1973 | Sweden | 98/36 |

*Primary Examiner*—William E. Wayner

[57] ABSTRACT

An air barrier device for an opening in a wall including air flow generating members arranged at opposite boundary edges of the opening on both sides of the opening and arranged to direct individual curtains of air obliquely towards each other and into the spaces separated by the wall to thereby define a closed air volume. Air flow sensing members are positioned at the opening and are operable to modify the operation of the air flow generating members in response to the detection of a net flow of air through the opening to stop the net air flow.

21 Claims, 8 Drawing Figures

DEVICE FOR PREVENTING THE FLOW OF AIR THROUGH AN OPENING BETWEEN TWO ROOMS OR SPACES

The present invention relates to a device for preventing the flow of air through an opening between two rooms or spaces or between a room and the outdoor environment, said device comprising members for air exhaust arranged along at least a portion of the boundary edges of the opening.

When it is desirable to maintain different temperatures in two rooms or spaces, which are separated by a partition wall having an opening, e.g., a doorway or a door, which is to be kept open, it is essential that the flow of air through the opening is prevented, since such a flow would cause equalization of the temperature in the two rooms or spaces. Also in spaces or rooms with a temperature which is to be maintained higher or lower than the ambient outdoor temperature, it is essential that the flow of air is prevented through the openings of the space or room to the environment. Thus, e.g., in cold storage buildings or rooms, in which the temperature must be maintained considerably below the ambient outdoor temperature, and in industrial buildings, in which the temperature at least in winter must be maintained above the outdoor temperature, it is frequently necessary that doors are kept open during extended periods for transports and other traffic, since it is time-wasting to open and close the doors. However, in order to make it possible to keep the door open it is required that outdoor air cannot enter into the room, since the in-flow of outdoor air into cold storage buildings or rooms will cause formation of ice and an increased load of the compressors with increased energy consumption as a consequence, and in industrial buildings cause a lowering of the indoor temperature.

In, e.g., a cold storage building or room a substantial saving of energy can be attained by preventing circulation of air through an open door to the outdoor environment, since the temperature in the cold storage building is typically of the order of −30° C, while the outdoor temperature on a warm summer day may rise to +30° C.

In department stores a vertical air curtain is frequently arranged in the doorway in order to prevent outdoor air from entering into the building. However, such a vertical air curtain, especially at severe outdoor conditions, has proved not to be efficient at workshop doors and the like, through which vehicles are passing. In addition, such an air curtain must be made very powerful which in cold storage buildings or rooms with the low temperatures therein, causes considerable discomfort for truck operators and other persons, which pass through the curtain. The powerful air curtain also causes lighter objects, such as cardboard boxes, to blow away from material handling cars and the like.

The Swedish laid-out specification 361 733 discloses another type of device for preventing the flow of air through an open door from outside and into a room. With said device the flow of air from outside and into the room is prevented by two vertical air curtains, generated from the lateral edges of the door and directed obliquely towards each other and outwards from the room. The device according to said specification, however, presents certain disadvantages, viz, on one hand, it prevents air flow in one direction only through the door, namely from outside and into the room, and, on the other hand, it supports the occurrence of cross-draught, if another opening, e.g., a window is opened in the room. The device will also have a tendency to create a vacuum in the room.

The object of the present invention is to eliminate said disadvantages of prior constructions and provide a device for efficiently preventing air flow in both directions through an opening between two spaces or rooms or between a room and the outdoor environment, by generating a stationary air volume in the opening, which completely fills said opening.

Said object is attained by means of a device of the kind specified above, which is characterized in that members are provided to generate by air exhaust at least two air curtains in each space or room, which curtains originate from the whole length of two opposite boundary edges of the opening or from the vicinity of said edges, and are directed obliquely towards each other to form a plough-shaped air curtain arrangement directed into each of the spaces or rooms, said arrangement defining a closed air volume, which fills the whole opening and extends therethrough a certain length into each of the spaces or rooms, said members for generating the air curtains in one of the spaces or rooms being adapted to take in air for exhaust from the same space for direct exhaust therein, whereas the members for generating the air curtains in the other space or room are arranged to take in air from said other space or room for direct exhaust therein, and in that sensing members are provided in or adjacent the opening for sensing the air flow therethrough and the direction of the flow and in response to said sensing, individually in each space or room, regulate the strength of the air exhaust and/or the direction of the air curtains so that the air flow is stopped.

Since the device according to the invention is so designed that air is taken in from the same space or room into which it is later exhausted, the substantial advantage is attained that the temperature of the space or room is not affected.

In one preferable alternative embodiment of the invention the device is made self-regulating by provision of sensing members at the upper and/or the lower part of the opening so as to sense an air flow occurring through the opening and the direction thereof and in response to said sensing regulate the air curtains by control of the air exhaust, so that the air flow will cease. In this manner the occurrence of cross-draught is automatically prevented if an additional opening in the room should be opened, and the pressure in the room will be maintained constant.

It is preferable to locate the sensing members at the upper and/or the lower part of the opening, since the major flow in air circulation will occur at the top and at the lower part of the opening, while the air in the center of the opening will remain relatively stationary. At the door of a cold storage building or room, e.g., cold air thus has a tendency to flow outwards at the lower part of the door, while warmer air will flow into the building at the top of the door. However, it is also possible to provide a plurality of sensing members at the lateral edges of the opening or the door along the total height thereof.

At a door from a room to the outdoor environment an automatic regulation of the intensity of the air curtains is obtained by means of the sensing members in response to changed outdoor conditions, so that air flow through the opening is prevented, even if the wind is blowing towards the doorway. In order to protect the air curtains outside the door from strong wind, it might be preferable to provide a protective wall portion at either side of the door, said wall portions extending outwardly at least on the level with the location at which the curtains meet.

By designing the device of the invention in such a way that the intensity of the air curtains at one side of the opening is increased at the regulation, while for some time it is weakened at the other side, a rapid adaptation to new conditions can be obtained.

In one advantageous embodiment of the invention the device comprises fans, which are provided with outlets to the environment, a valve being arranged to regulate the size of the outlets and thereby the strength of the air exhaust for generating the curtains. In this way it is possible to regulate the air curtains by means of said valves, while the fans are permanently operated with constant power. This is an important advantage when the device is utilized in cold storage buildings or rooms, since rapid and exact regulation of the operation of the fans is difficult to perform at the low temperatures existing there.

In one embodiment of the device according to the invention each sensing member is an air flow responsive element comprising a closed receptacle, which by a diaphragm is divided into two halves, said receptacle presenting an inlet and an outlet so that an air flow actuates the diaphragm.

In another embodiment of the invention the sensing members each comprise, as an air flow responsive element, a heated tungsten wire or a thermistor which is cooled by air flow whereby the resistance thereof is changed. However, it is then required that a correction be introduced for the change of the cooling which is caused by variations in the temperatures of the spaces or rooms. It is well known that outside a door to the outdoor environment the temperature variation between a severe winter day and a warm summer day may be in the order of 50° C.

According to still another advantageous embodiment of the device according to the invention an alarm means is connected to the sensing members to be released if the air flow does not cease within a predetermined time. The alarm is thus released, e.g., if a fan ceases operation.

In spaces or rooms with a plurality of openings which are to be kept open during a longer period, a device according to the invention is preferably disposed at each opening.

In order to explain the invention more in detail an exemplary embodiment is described below with reference to the accompanying drawings, in which FIG. 1 is a lateral cross section view of the device according to the invention at an opening in a partition wall between two rooms or between a room and the outdoor environment.

Figure 8:
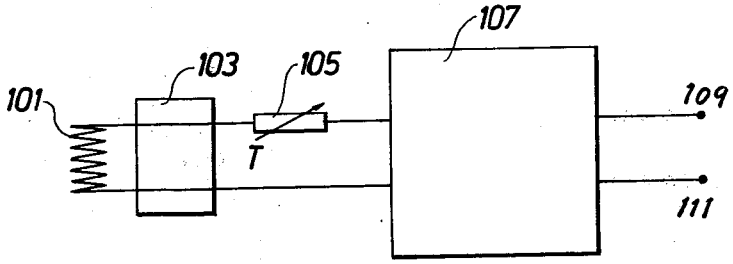

And FIG. 8 illustrates an alternative automatic control feature.

Figure 1:
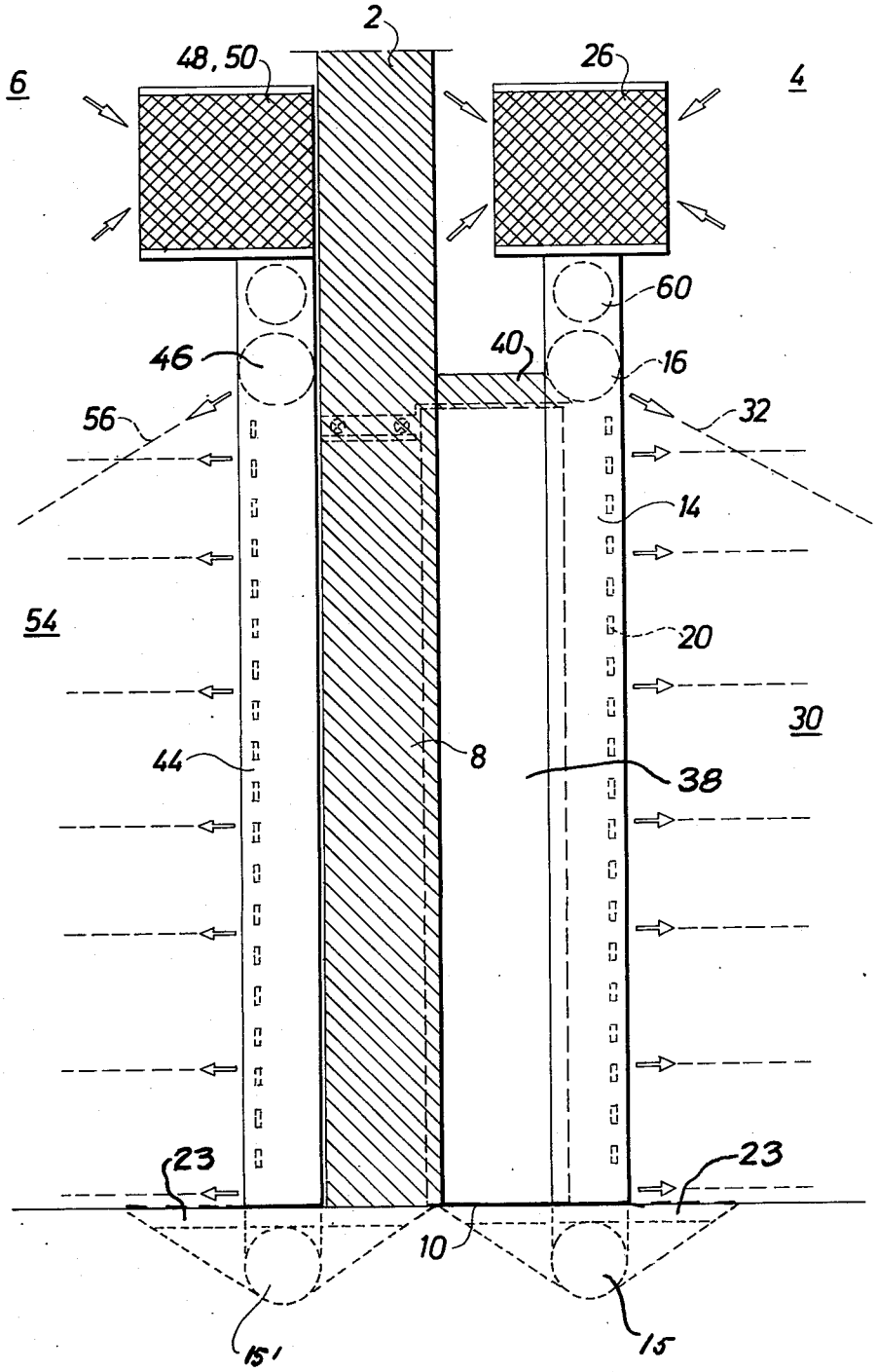

FIG. 1 shows in lateral cross-section a partition wall 2 between two rooms or a room and the outdoor environment 4, 6. In the wall 2 an opening is provided, e.g., a door, which extends down to the floors 10 of the rooms 4, 6. The room 4 may be, e.g., a cold storage building or an industrial building, while 6 indicates the outdoor environment, the door 8 being provided for transports and other traffic.

Spaced from the partition wall 2 air drains 12, 14 are arranged in the room 4 in parallel with the lateral edges of the opening 8. Similarly, spaced from the wall 2 a third air drain 16 is arranged in parallel with the top edge of the opening 8, said drain being in communication with the two first-mentioned drains 12, 14, see FIGS. 2 and 3. Each air drain 12, 14, 16 is provided with a row of holes 18, 20, 22. In the top ends of the lateral drains 12, 14 fans 24, 26 are provided for generation of air curtains by exhaust of air through said rows of holes. The holes 18, 20 in the lateral drains 12, 14 are then directed in such a way that from said air drains two substantially vertical air curtains 28, 30 are obtained, which are directed inwards into the room 4 and obliquely towards each other so that they meet along a substantially vertical line spaced from the opening 8, as illustrated in FIG. 3. The holes 22 in the third drain 16 are directed so that a third curtain 32 is obtained, which is directed inwards into the room 4 and obliquely downwards from the drain 16, see FIG. 1.

In the room 4 the air drains 12, 14, 16 are arranged spaced out from the partition wall 2 in order to make room for the opening of the door 34 provided for closing the opening 8. In FIG. 3 the door is shown as being of foldable type. From the partition wall 2 two walls 36, 38 extend to the lateral drains 12, 14 and a ceiling 40 is provided between the partition wall 2 and the overlying drain 16, see FIGS. 1 and 3.

On the other side of the partition wall 2 a similar drain and fan assembly is provided. However, on this side of the partition wall the drains 42, 44, 46 and the fans 48, 50 are located directly adjacent the partition wall, since on this side of the wall no room is required for the opening of the door 34. By means of this latter drain and fan assembly three air curtains 52, 54, 56 are generated also on this side of the partition wall 2 in the same manner as in the room 4, see FIGS. 1 and 3.

The three air curtains in each space 4, 6 together with the floor 10 and the boundaries 36, 38, 40 of the opening 8, delimit a closed, stationary air volume which fills the whole opening 8 and extends a certain distance into each space. The larger this volume, the more insensitive the operation of the device will be to occasional disturbances, such as, e.g., variations in the speeds of the fans.

In order to maintain the temperatures existing in the respective spaces it is essential that the fans 24, 26 which generate the air curtains in one of the spaces 4 for the air exhaust take in air from the same space, while the fans 48, 50 for generating the air curtains in the other space 6 take in air from said other space.

By designing the air drains 12, 14, 16 and 42, 44, 46 rotatable around the longitudinal axes thereof it is possible to vary the directions of the air curtains. This feature is described further below in connection with FIG. 5 and FIG. 6.

The size and the number of the holes in the air drains are adapted to the capacity of the fans, so that air curtains of a desired strength and intensity are obtained.

Figure 2:
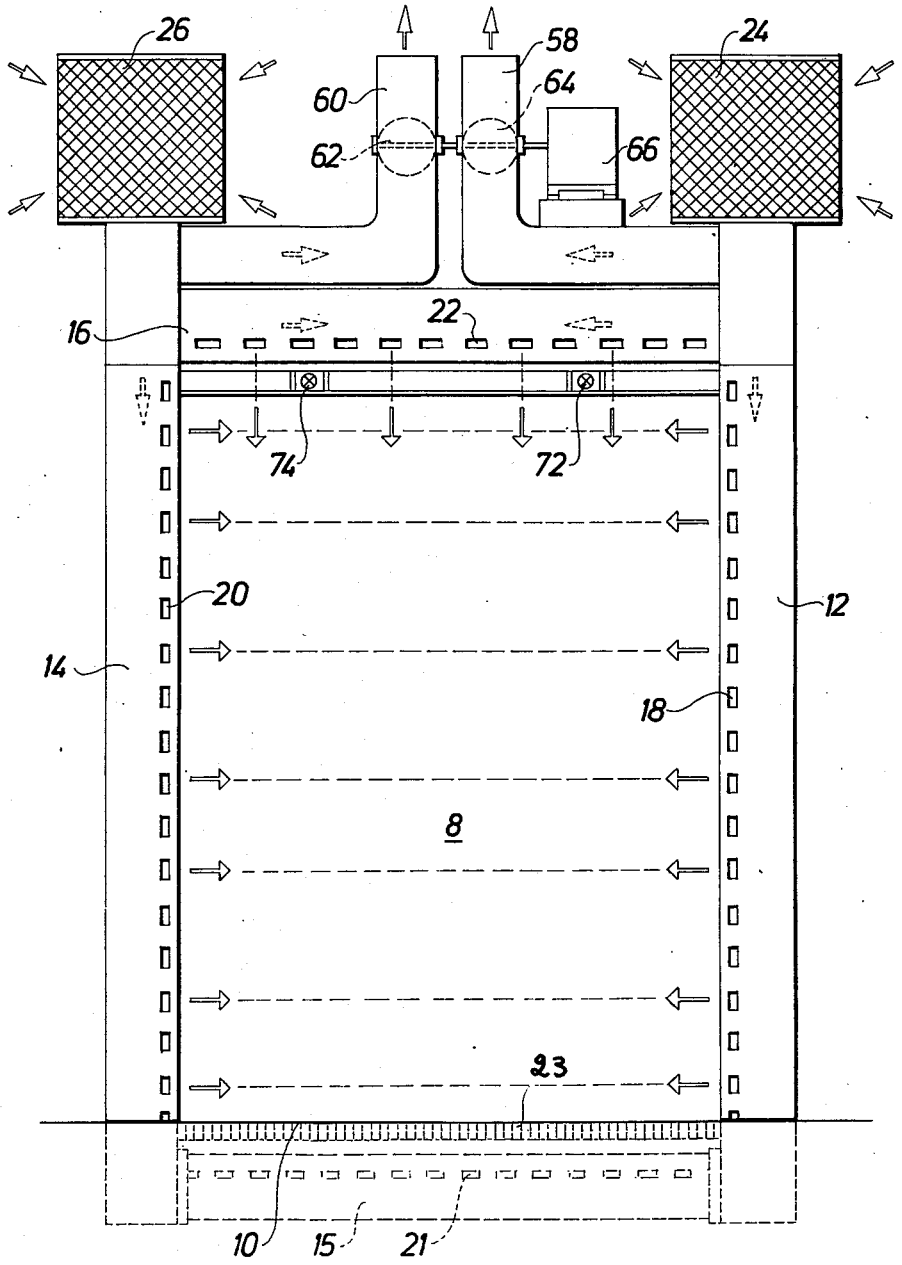
FIG. 2 is a front view of the device of FIG. 1 from one of the rooms.
Figure 3:
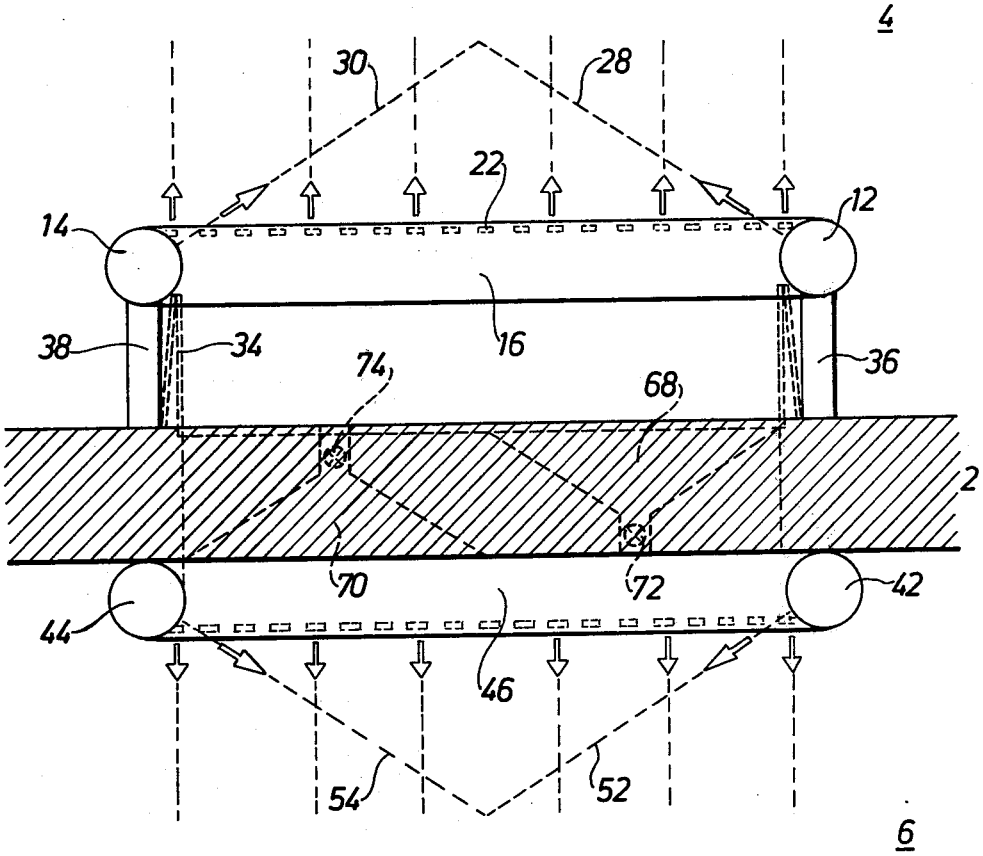
FIG. 3 is a top view of the device of FIG. 1.

In order to provide for a simple possibility of controlling the intensity of the air curtains an outlet drain 58, 60 is directly connected to the outlet of each fan 24, 26 in the lateral drains 12, 14, see FIG. 2. The size of the opening of the outlet drains is adjustable by means of motor-operated valves 62, 64. In this way it is possible to adjust the strength of the air exhaust through the drains without the requirement of varying the fan speed. This is an important advantage when the device is located, e.g., in a cold storage building, since adjustment of the fans may be associated with considerable difficulties at the low temperatures existing there.

The device according to the invention comprises also automatic control means for modifying the intensity of the air curtains in response to variations in the outside conditions, so that air flow through the opening 8 is permanently prevented. The control means comprise two funnel-shaped passage-ways 68, 70, located at the top edge of the opening 8 from one of the spaces to the other, as illustrated in FIG. 3. The funnel-shaped passage-ways 68, 70 are directed in opposite directions and contain each an air flow responsive element in the narrow portion of the passage-way. Upon an air flow in a direction, e.g., from the space 4 towards the space 6, a powerful air flow is obtained in the narrow portion of the passage-way 68 by funnel action, while the flow in the corresponding portion of the passage-way 70 is small. Consequently, with the elements 72 and 74 it is possible to detect both the strength of the air flow as well as the direction thereof. In response to the air flow detected, the elements 72, 74 supply electric signals which control the valves in the outlet drains 58, 60, whereby the air curtains are changed in such a manner that the air flow is discontinued.

By means of the automatic control device, compensation is also directly obtained for possible tendencies to cross-draught if an additional opening, e.g., a window, is opened in a room or other space.

In order to stop an occurring air flow rapidly it is preferable to allow the signals from the elements 72, 74 in response to a detected flow direction to shut the valves in the outlet drains from the fans on one side of the partition wall 2 and increase the opening of the valves in the outlet drains from the fans on the other side of the wall 2, whereby an amplification of the air curtains on one side of the partition wall is obtained at the same time as a weakening of the air curtains on the other side of the wall.

In the exemplary embodiment shown in FIG. 3 the sensing members 68, 70, 72, 74 are disposed at the top edge of the opening 8. However, in certain applications it might instead be preferred to provide the sensing members at the bottom edge of the opening or both at the top edge of the opening and at the bottom edge thereof. Upon a tendency to circulation in the opening cold air will flow through the lower part of the opening and warmer air will pass at the upper part thereof, whereas the air in the middle of the opening will remain fairly stationary. It is also possible to provide the sensing members at the lateral edges of the opening with a plurality of oppositely directed passages arranged one above the other.

Figure 4:
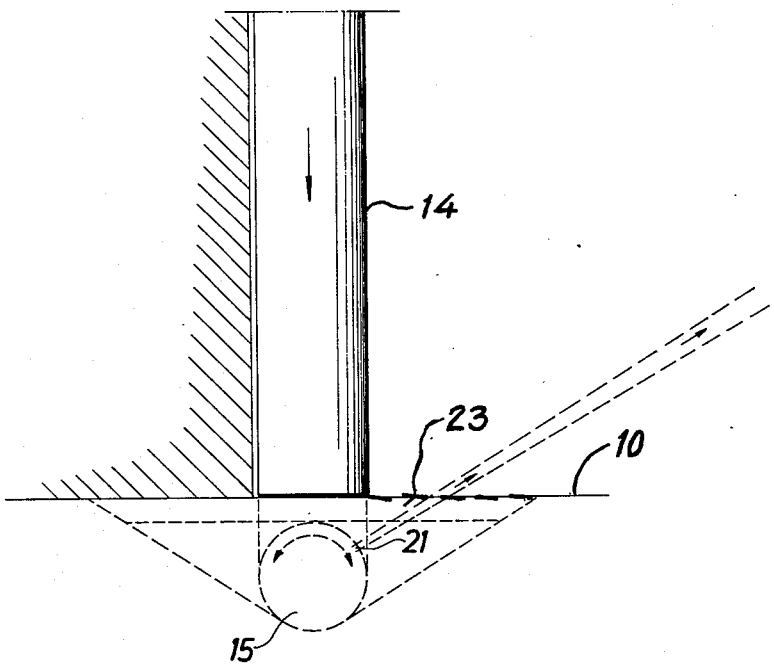
FIG. 4 is an enlarged detail view illustrating a bottom corner of the device of FIG. 1.

Optionally, if desired, a fourth air drain element 15 may be horizontally arranged beneath the floor 10 and connected with the vertical drains 12, 14 for directing air upwardly and outwardly into the space 4 through a grating 23, as illustrated in FIG. 1 and FIG. 2. Thus, air curtains may be provided around all four edges of the door opening. Similarly, as indicated at 15' in FIG. 1, a fourth drain may be provided beneath the floor 10 and connected to the drains 42, 44 to provide a fourth air curtain into the space 6 through the grating 23. FIG. 4 is a detail view illustrating how the drain 15 provides an upwardly and outwardly directed air curtain through the grating 23 from holes 21 within the drain 15.

Figure 5:
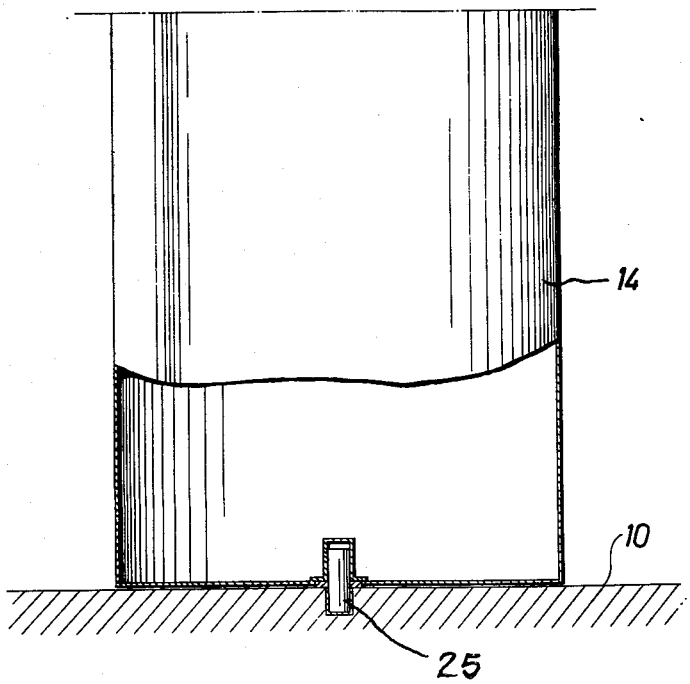
FIG. 5 is an enlarged detail of the same bottom corner of the device shown in FIG. 4, but illustrating a modification thereof.
Figure 6:
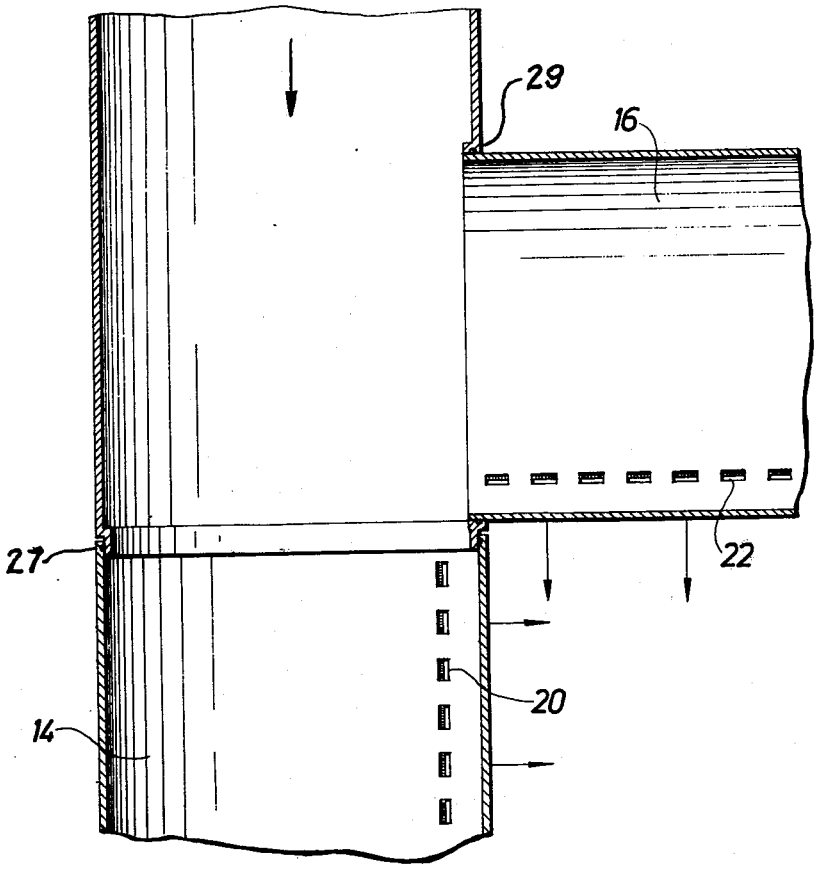
FIG. 6 is an enlarged sectional detail corresponding to a portion of the device as illustrated in the front view of FIG. 2, but illustrating a modification.

As previously mentioned above, the air drains 12, 14, 16, and 42, 44, 46 may be designed to be rotatable about the longitudinal axes thereof, and to thus vary the directions of the air curtains. This feature is illustrated in the detail views of FIGS. 5 and 6 as applied to a version of the apparatus providing only three air curtains at each side of the opening. Thus, as illustrated in FIG. 5, the vertical drains, such as 14, may be rotatable about a pin 25 which may be inset into the floor 10. Also, near the upper end of each vertical drain, such as drain 14, as shown in FIG. 6, there may be provided a joint shown at 27 which permits rotation between the drain 14 and the remainder of the structure. Similarly, a suitable rotation permitting joint may also be provided for the horizontal drain 16 as indicated at 29.

Figure 7:
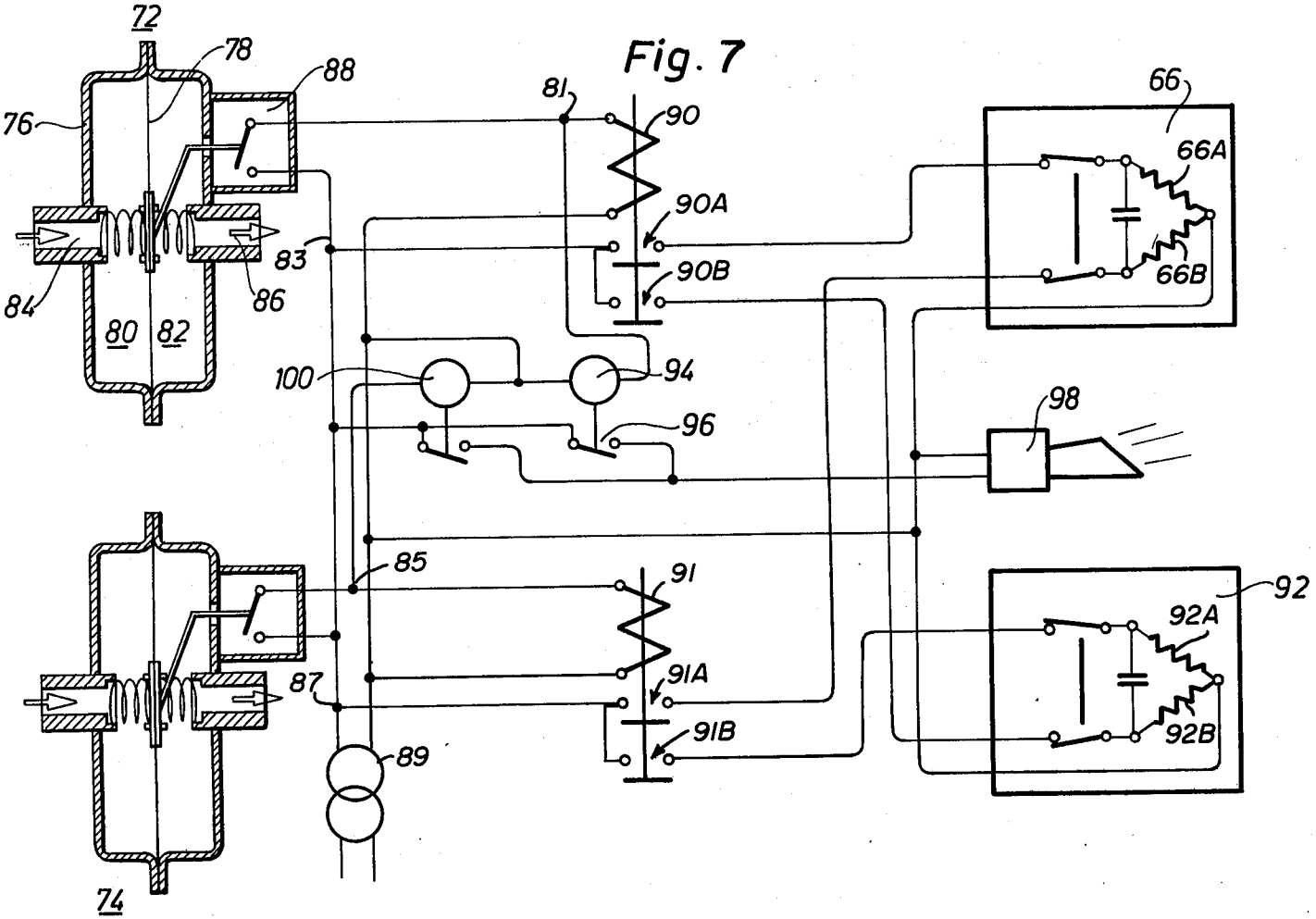
FIG. 7 is a diagram of the electrical features of the automatic control for the device and also illustrating an alarm.

FIG. 7 shows a diagram of an exemplary embodiment of automatic control means. In the embodiment illustrated each of the air flow responsive elements 72, 74 comprises a closed receptacle 76, which is divided into two halves by a sensitive, spring-biased diaphragm 78. One of the halves 80 of the receptacle has an inlet 84 directed towards a widened portion of the passage-way 68, while an outlet 86 from the other half 82 opens into the other portion of the passage-way 68.

Upon a tendency of air flow through the passage-way 68 the pressure will rise on one side of the diaphragm 78 and the diaphragm 78 is urged towards the right hand side in the figure, whereby a microswitch 88 is actuated by the movement of the diaphragm 78. When the microswitch 88 is closed the resultant closure of the circuit between points 81 and 83 completes a circuit from power source 89 to cause relay 90 to pick up. This closes a circuit from the power source through relay contacts 90A to one of the windings 66A of the reversible first control motor 66. Motor 66 is thus driven to open the valves 62, 64 (see FIG. 2) in the fan outlets 58, 60 on one side of the partition wall. Similarly, the closure of relay contact 90B completes a circuit to the lower winding 92B of the second reversible control motor 92. Thus, motor 92 is driven simultaneously to close the valves in the fan outlets on the other side of the partition wall. In this way the air curtains are modified in such a manner that the air flow will cease.

In the second passage-way 70 (see FIG. 3) a similar air flow responsive element 74 is provided for controlling the motors 66, 92 in the opposite direction upon an air flow in the opposite direction, so that even in this case the air flow is stopped. Thus, upon the closure of the switch within the flow responsive element 74, a circuit is completed between points 85 and 87 to pick up the associated relay 91. The resultant closure of relay contacts 91A energizes the reverse winding 66B of motor 66, and the closure of relay contacts 91B causes completion of the circuit to the forward winding 92A of the second control motor 92.

Several types of control or regulating motors suitable for the purpose are commercially available. A suitable motor is a throttle or regulating motor, Type ME5, manufactured by Billman.

The control of the valves from the air flow responsive elements can, of course, be modified in a plurality of ways.

An alarm means is preferably adapted to be controlled by the signals from the air flow responsive elements, said alarm means being arranged to be released if the air flow has not ceased within a predetermined time. In this manner an automatic alarm is obtained if a fault occurs in the device, e.g., if a fan ceases operation.

FIG. 7 shows an exemplary embodiment of such alarm means. When the switch 88 is closed, the time switch 94 is started. If the time switch 94 is not de-energized within a certain predetermined time, the contact 96 of the time switch 94 is closed and an acoustic alarm in the form of a hooting signal horn 98 is started. The time switch 94 is reset automatically, when it is de-energized. The alarm means also comprises a time switch 100 which is controlled in the same manner by the second air flow responsive element 74.

A visual alarm can also be utilized, instead of the acoustic alarm, or in combination therewith.

As an alternative to the pressure responsive flow detection elements 72 and 74, air flow responsive elements based upon heat dissipation may be employed. For instance, a heated tungsten wire or a thermister can be utilized which is cooled by air flow through the passageway so that the resistance thereof is changed, said change being converted into an electric control signal for the regulating motors. Such an arrangement is illustrated in FIG. 8, where a heated tungsten filament 101 is supported by a holder 103 and in circuit with a variable resistor 105 by means of which the current to the filament can be adjusted to provide for a variation in the operation thereof. Within the box 107 there is included a current source for the filament 101, and a current flow detection circuit, which may be conventionally constructed, and which causes a voltage to appear across output connections 109 and 111 whenever substantial heat dissipation from the filament 101 caused by an increase in air flow occurs. The voltage across 109 and 111 can be connected to pick up a relay such as relay 90 of FIG. 7, and the remainder of the control circuit is essentially the same as illustrated in FIG. 7. A second set of the circuit elements illustrated in FIG. 8 is also employed and connected to relay 91 to detect air flow in the other direction.

At openings, which are not bounded by floors, ceilings or side walls, it is actually required that air drains are provided around all edges of the opening to have a closed air volume through the opening defined.

One embodiment at a quadrangular opening has been described above, but it should be easily understood that the device according to the invention can also be adapted to openings of different shape by simple modifications.

I claim:

1. A device for preventing flow of air through an opening in a wall between two spaces wherein air flow generating members are provided to generate by air exhaust at least two air curtains in each space, said two curtains originating from the vicinity of the whole length of two opposite boundary edges of the opening, said air curtains being directed obliquely towards each other to form a wedge-shaped air curtain arrangement directed into each of the spaces, said arrangement defining a closed air volume which fills the whole opening and extends therethrough a certain length into each of the spaces, each of said air flow generating members for generating the air curtains in each of the spaces being adapted to take in air for exhaust from the same space into which the air is exhausted, sensing members at the opening for sensing the air flow therethrough and the direction of the net air flow through the opening, regulating means connected to said sensing members and to said air flow generating members and responsive to the detection of the direction of air flow by said sensing members to regulate the air curtains so that the net air flow is stopped.

2. A device as claimed in claim 1 wherein the regulation of the air curtains by said regulating means is carried out by regulating the relative strength of the air exhaust into the two spaces.

3. The device as claimed in claim 1 wherein additional air flow generating members are provided for generating in each of the spaces an additional air curtain which originates from one edge of the opening extending between said opposite edges, said additional air curtain being directed into the space obliquely inwardly across the projection of the opening.

4. The device as claimed in claim 3 wherein said opening is a quadrangular door and said air flow generating members are disposed along the lateral edges of the door and along the top edge thereof and so shaped that in each of the spaces the associated air flow generating members generate two substantially vertical air curtains which are directed obliquely towards each other so that, in each of the spaces or rooms, they meet along a line spaced from the door, and a third air curtain which extends from the vicinity of the top edge of the door obliquely downwards and into each of the spaces.

5. The device as claimed in claim 1 wherein air flow generating members are provided around all the boundary edges of the opening for generating air curtains by exhaust of air in each of the spaces in which the exhaust of air originates from all the boundary edges of the opening and in which the air curtains are directed obliquely towards each other.

6. The device as claimed in claim 4 wherein air flow generating members are provided also along the bottom edge of the door for generating in each of the spaces still another air curtain which extends from the vicinity of the bottom edge of the door obliquely upwards in each of the spaces so that it meets the downwardly directed air curtain along a substantially horizontal line and spaced from the door.

7. The device as claimed in claim 1 wherein said air flow generating members for the exhaust of air comprise air drains provided in each of the spaces and fan means in communication with said air drains, said air drains each presenting a row of holes extending along the total length thereof, said holes being directed into the associated space so that said air curtains are generated upon the exhaust through said holes of air by means of the fan means.

8. The device as claimed in claim 7 wherein said opening is a quadrangular door and wherein air drains are provided in each of the spaces or rooms at the lateral edges of the opening and at the top edge thereof with associated rows of holes extending along said edges, said holes along the lateral edges being directed obliquely inwards across the opening and the holes along the top edge being directed obliquely downwards and into the space or room, said fan means comprising two fans in each of the spaces connected to each of the air drains disposed along the lateral edges of the opening, the air drain disposed along the top edge of the opening being in communication with said drains.

9. The device as claimed in claim 8 wherein still another air drain is provided at the bottom edge of the opening in each of the spaces, said last mentioned drain being in communication with the air drains located at the lateral edges of the opening.

10. The device as claimed in claim 1 wherein protective wall portions are provided on each side of the opening, said wall portions extending at least to the level of the location at which the air curtains meet as a protection for the air curtains outwardly from the opening.

11. The device as claimed in claim 7 wherein the air drains are rotatable around their longitudinal axes for altering the direction of the air curtains.

12. The device as claimed in claim 7 wherein each of said fan means includes one outlet in addition to said drain means with a valve being provided in each outlet to control the size of the outlet and thereby the strength of the air exhaust through the air drains at constant operation of the fan means.

13. The device as claimed in claim 1 wherein said sensing members are positioned near at least one horizontal marginal edge of the opening and arranged to control the fan means to alter the air curtains by controlling the strength of the air exhaust through the different air drains so that the net air flow is stopped.

14. The device as claimed in claim 12 wherein the fans of the fan means are controlled in response to the direction of the sensed net air flow by changing the size of the outlets to increase the strength of the air exhaust in one of the spaces while the strength of the air exhaust is reduced in the other space.

15. The device as claimed in claim 13 wherein the sensing members comprise two funnel-shaped passage-ways between the spaces, said passage-ways being oppositely directed and containing one air flow sensitive element in the narrow portion of each of the passage-ways and which in response to the sensed air flow supply electric signals for the control of the opening of the valves in said fan outlets.

16. The device as claimed in claim 15 wherein the signals from the air flow responsive elements control regulating motors which in their turn are adapted to regulate the opening of the valves in the fan outlets in response to said control.

17. The device as claimed in claim 15 wherein each air flow responsive element comprises a closed receptacle including a diaphragm dividing said receptacle into two halves, one half of said receptacle having an inlet directed towards the widened portion of the funnel-shaped passage-way and wherein an outlet from the other half of the receptacle opens into the other portion of the passage-way.

18. The device as claimed in claim 15 wherein each air flow responsive element comprises a heated tungsten wire, which is cooled upon air flow through the passage-way so that the resistance thereof is altered.

19. The device as claimed in claim 15 wherein each air flow responsive element is a thermistor, which is cooled upon air flow through the passage-way.

20. The device as claimed in claim 15 wherein a unit is provided for sensing the temperature in the spaces and for correcting said electric signals in response to the varying cooling of the air flow responsive elements which is caused by the varying temperatures in the spaces.

21. The device as claimed in claim 1 wherein an alarm means is connected to said sensing members and operable to sound an alarm if the air flow is not stopped within a predetermined time.

* * * * *

UNITED STATES PATENT AND TRADEMARK OFFICE

CERTIFICATE OF CORRECTION

PATENT NO. : 4,074,620

DATED : February 21, 1978

INVENTOR(S) : Bror Ingvar Erling Jansson

It is certified that error appears in the above-identified patent and that said Letters Patent are hereby corrected as shown below:

Column 3, line 9, before "regulation" "at the" should read --for--;
after "while" "for" should read --at the--;
line 10, before "time" "some" should read --same--.
Column 9, line 27, after "extending" insert --outwards--.

Signed and Sealed this

*Eleventh* Day of *July 1978*

[SEAL]

*Attest:*

RUTH C. MASON
*Attesting Officer*

DONALD W. BANNER
*Commissioner of Patents and Trademarks*